US007144263B2

(12) United States Patent
Kamath

(10) Patent No.: US 7,144,263 B2
(45) Date of Patent: Dec. 5, 2006

(54) SHORTING BAR CONNECTOR

(75) Inventor: Shashidhar M Kamath, Canton, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/997,125

(22) Filed: Nov. 24, 2004

(65) Prior Publication Data

US 2006/0110964 A1 May 25, 2006

(51) Int. Cl.
*H01R 29/00* (2006.01)

(52) U.S. Cl. ..... 439/188; 200/51.1

(58) Field of Classification Search ..... 439/188, 439/352, 488, 489, 372, 752; 200/51.1, 51.09, 200/51.11

See application file for complete search history.

(56) References Cited

U.S. PATENT DOCUMENTS

| | | | | |
|---|---|---|---|---|
| 4,029,917 | A | 6/1977 | Webster | |
| 4,376,234 | A | 3/1983 | Liataud et al. | |
| 4,428,649 | A | 1/1984 | Main et al. | |
| 4,454,391 | A | 6/1984 | Olsson | |
| 4,833,280 | A | 5/1989 | Bingo et al. | |
| 4,841,105 | A | 6/1989 | Goodman et al. | |
| 4,904,196 | A | 2/1990 | Sueyoshi et al. | |
| 4,978,311 | A | 12/1990 | Oda et al. | |
| 5,035,644 | A | 7/1991 | Nakazato et al. | |
| 5,131,865 | A | 7/1992 | Taguchi et al. | |
| 5,516,300 | A | 5/1996 | Tsuji | |
| 5,538,434 | A | 7/1996 | DelGuidice et al. | |
| 5,672,073 | A * | 9/1997 | Matsumura et al. | 439/489 |
| 5,897,389 | A | 4/1999 | Dietz et al. | |
| 5,944,547 | A * | 8/1999 | Golab et al. | 439/188 |
| 6,244,884 | B1 * | 6/2001 | Kerul | 439/262 |
| 6,333,479 | B1 | 12/2001 | Tai | |
| 6,786,747 | B1 | 9/2004 | Kamath | |

* cited by examiner

*Primary Examiner*—James R. Harvey
(74) *Attorney, Agent, or Firm*—Harness, Dickey & Pierce, P.L.C.

(57) ABSTRACT

An electrical connector generally includes a housing having at least a first electrical terminal and a second electrical terminal. A shorting bar slidably connects to the housing and has at least a first spring portion and a second spring portion. The shorting bar is movable between a shorted condition and a non-shorted condition. The spring portions on the shorting bar are in a relaxed position in the non-shorted condition. Because the connector is typically in the non-shorted condition, the spring portions are less susceptible to stress relaxation.

12 Claims, 9 Drawing Sheets

SHORTING BAR CONNECTOR

FIELD

The present invention relates to an electrical connector assembly and more specifically to a shorting bar in a connector.

BACKGROUND

Traditionally, a female connector can receive a male connector to form an electrical connection. A shorting bar, which is typically a flexible metal strip, is connected to a housing of the female connector. The shorting bar can short two or more electrical terminals to thereby equalize the electrical potential therebetween.

A portion of the shorting bar can be configured like a spring such that in its relaxed condition, the shorting bar lays on the terminals. By lying on the terminals, the shorting bar can electrically connect (i.e., short) the terminals to one another. When the male connector is inserted into the female connector, the male connector can bend the shorting bar up toward the housing to break the electrical connection between the terminals (i.e., remove the short). It will be appreciated that the shorting bar remains bent toward the housing (i.e., against a bias of the spring) while the female and the male connectors are mated.

Typically, the connectors are mated throughout the duration of their functional life. When the female and the male connectors are unmated after being connected for a relatively long period of time, the shorting bar can remain in a deflected condition (e.g., bent up toward the housing) due to memory of the material of which the shorting bar is made. If the shorting bar remains in the deflected condition, the shorting bar will no longer short the terminals of the female connector.

SUMMARY

An electrical connector generally includes a housing having at least a first electrical terminal and a second electrical terminal. A shorting bar slidably connects to the housing and has at least a first spring portion and a second spring portion. The shorting bar is movable between a shorted condition and a non-shorted condition. The spring portions on the shorting bar are in a relaxed position in the non-shorted condition.

Further areas of applicability of the present invention will become apparent from the detailed description provided hereinafter. It should be understood that the detailed description and specific examples, while indicating the various embodiments of the invention, are intended for purposes of illustration only and are not intended to limit the scope of the invention.

BRIEF DESCRIPTION OF THE DRAWINGS

The present invention will become more fully understood from the detailed description, the appended claims and the accompanying drawings, wherein:

DETAILED DESCRIPTION

The following description of the various embodiments is merely exemplary in nature and is in no way intended to limit the invention, its application, or uses.

Figure 1:
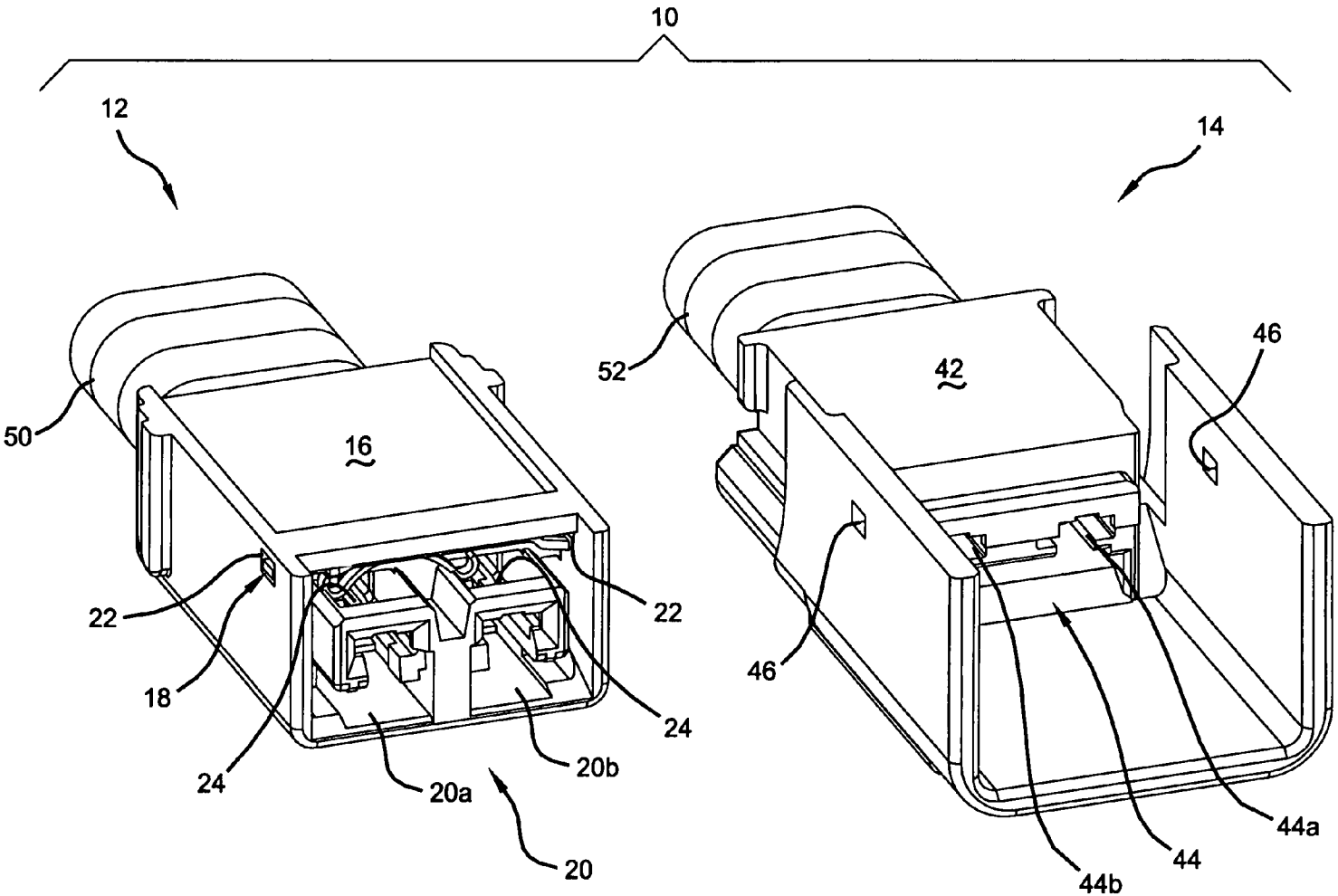
FIG. 1 is a perspective view of a connector assembly including a male connector and a female connector having a shorting bar constructed in accordance with the teachings of the present invention.

With reference to FIG. 1, a connector assembly 10 is shown constructed in accordance with the teachings of the present invention. The connector assembly 10 includes a female connector 12 and a male connector 14. The female connector 12 includes a female housing 16, a shorting bar 18, and at least a first electrical terminal 20*a* and a second electrical terminal 20*b*, which may be collectively referred to as female terminals 20. The female housing 16 includes a pair of apertures 22 that receive the shorting bar 18. Each of the female terminals 20 may be configured with various suitable electrical connectors, such as, but not limited to, a spade connector.

Each of the female terminals 20 may include a contact plate 24 (i.e., a first contact plate 24*a*, a second contact plate 24*b* etc.). The shorting bar 18 may electrically connect to the contact plates 24 of the female terminals 20 to short the female connector 12. By shorting the female connector 12, the shorting bar 18 can equalize the electrical potential between two or more of the female terminals 20. While the shorting bar 18 may make electrical contact with two or more of the female terminals 20 (i.e., short the terminals), the shorting bar may need not be configured to short all of the female terminals 20 in a female connector configuration with more than two of the female terminals 20.

Figure 2:
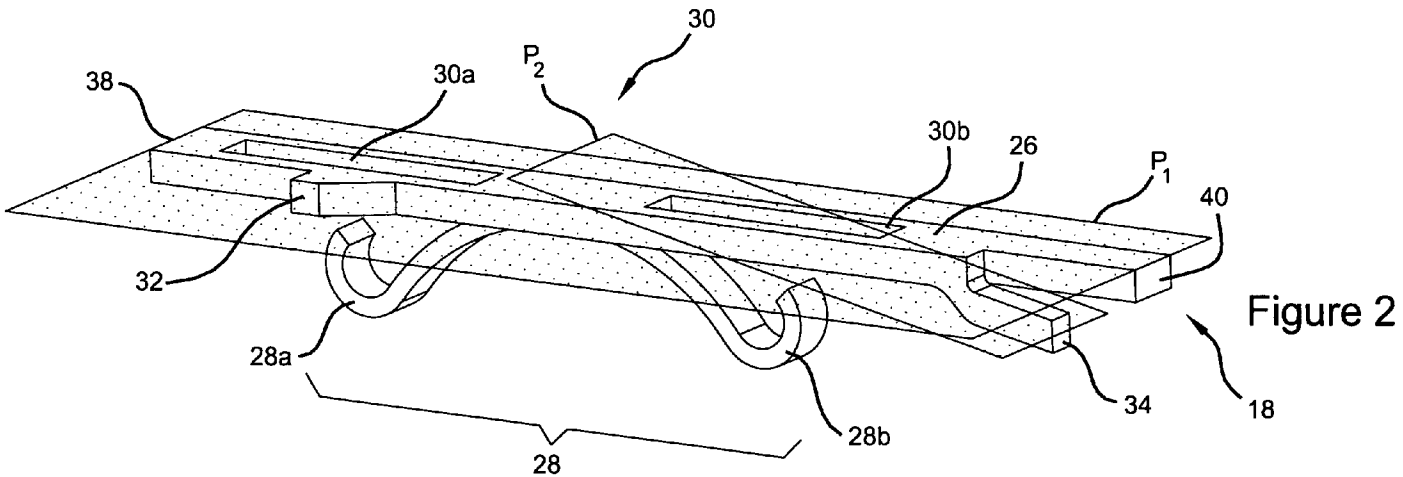
FIG. 2 is a perspective view of the shorting bar of FIG. 1.
Figure 3:
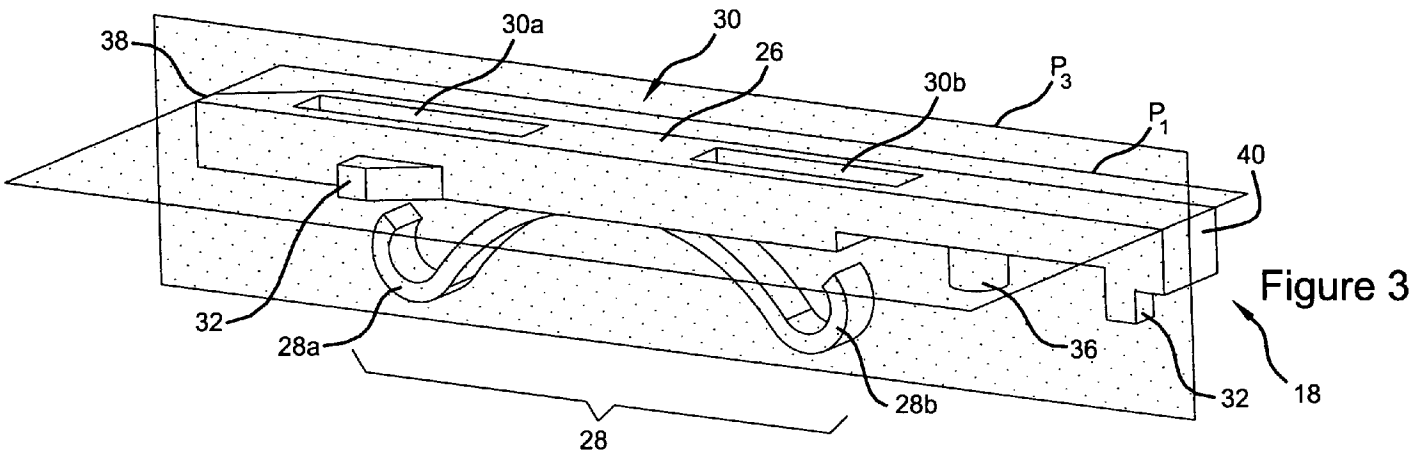
FIG. 3 is a perspective view of alternative construction of the shorting bar of FIG. 1.

With reference to FIGS. 2 and 3, the shorting bar 18 includes a bar portion 26, a first spring portion 28*a* and a second spring portion 28*b*, which may be collectively referred to as spring portions 28. It will be appreciated that the shorting bar 18 may include multiple spring portions 28. The amount of spring portions 28 may be, but need not be, equal to the amount of the female terminals 20. The shorting bar 18 also includes a first spring aperture 30*a* and a second spring aperture 30*b*, which may be collectively referred to as spring apertures 30. In one embodiment, the shorting bar 18 also may include a protrusion 32 and a flange 34, as shown in FIG. 2. In another embodiment, the shorting bar 18 may also include a post 36 or a cam follower 36, as shown in FIG. 3. The shorting bar 18 can also include the protrusions 32 adjacent the first end 38 and the second end 40. It will also be appreciated that either the protrusions 32, the flange 34 and/or other suitable members may be included on the shorting bar 18.

The bar portion 26 includes a first end 38 and a second end 40. The bar portion 26 may have a rectangular cross-section, but may be configured with other cross-section shapes, such as, but not limited to, circular or square cross-sections. The spring portions 28 connect to the bar portion 26 and may extend below the spring apertures 30 formed in the bar portion 26. It will be appreciated that the spring apertures 30 can be formed in the bar portion 26 when the spring portions 28 are formed from the bar portion 26. For example, the spring portions 28 can be cut or stamped from the bar portion 26, such that the forming process leaves the spring apertures 30 in the bar portion 26. It will also be appreciated that the spring portions 28 (singularly, in groups or a unitary structure) can be connected to the bar portion 26 with fasteners and/or chemical bonding. By way of this example, the spring apertures 30 may be optionally formed in the bar portion 26.

In one embodiment, the protrusion 32 and the flange 34 connect to the bar portion 26 and extend in a direction from the bar portion 26 that may be generally orthogonal to the spring portions 28, as shown in FIG. 2. The bar portion 26 is parallel to a first plane ($P_1$) and the protrusion 32 extends from the bar portion 26 in a direction that is parallel to the first plane ($P_1$). The flange 34 extends from the bar portion 26 in a direction that is parallel to a second plane ($P_2$). The first plane ($P_1$) and the second plane ($P_2$) intersect. In another embodiment, the protrusion 32 and the post 36 connect to the bar portion 26. The protrusion 32 extends in a direction from the bar portion 26 that may be generally orthogonal to the spring portions 28, while the post 36 may extend in the same direction from the bar portion 26 as the spring portions 28, as shown in FIG. 3. The post 36 extends from the bar portion 26 in a direction that is parallel to a third plane ($P_3$). The first plane ($P_1$) and the third plane ($P_3$) intersect.

With reference to FIG. 1, the male connector 14 includes a male housing 42, and at least a first electrical terminal 44*a* and a second electrical terminal 44*b*, which may be collectively referred to as male terminals 44. The male housing 42 includes a pair of apertures 46 that may receive the shorting bar 18. Each of the male terminals 44 may be configured with a mating complement to the respective female terminal 20. It will be appreciated that amount of the female terminals 20 need not be equal to the amount of the male terminals 44. By way of example, a female connector may be configured with four of the female terminals 20 and a male connector may be configured with three male terminals 44. The male connector, however, may have the capacity to receive the four female terminals 20 such that the male housing and female housing will mate.

Each of the male terminals 44 includes a contact plate 48 (i.e., a first contact plate 48*a*, a second contact plate 48*b* etc.). In an alternative embodiment (not shown), the shorting bar 18 may be installed in the male connector 14 and electrically connect to the contact plates 48 of the male terminals 44 to short the male connector 14. By way of the above example, the pair of apertures 46 formed in the male housing 42 may receive the shorting bar 18, in a similar fashion to the female connector 12.

An electrical wire 50 having multiple conductors (not shown) may connect to the male connector 14, such that each of the contact plates 48 can be electrically coupled to a respective one of the conductors. A similar electrical wire 52 may connect to the female connector 12, such that each of the contact plates 20 can be electrically coupled to a respective one of the conductors. Each of the conductors of the electrical wires 50, 52 may couple to each of the male and the female terminals 20, 44, respectively, in a manner known in the art. It will be appreciated that by mating the female connector 12 to the male connector 14, the electrical wires 50, 52 may be electrically connected to one another.

Figure 4:
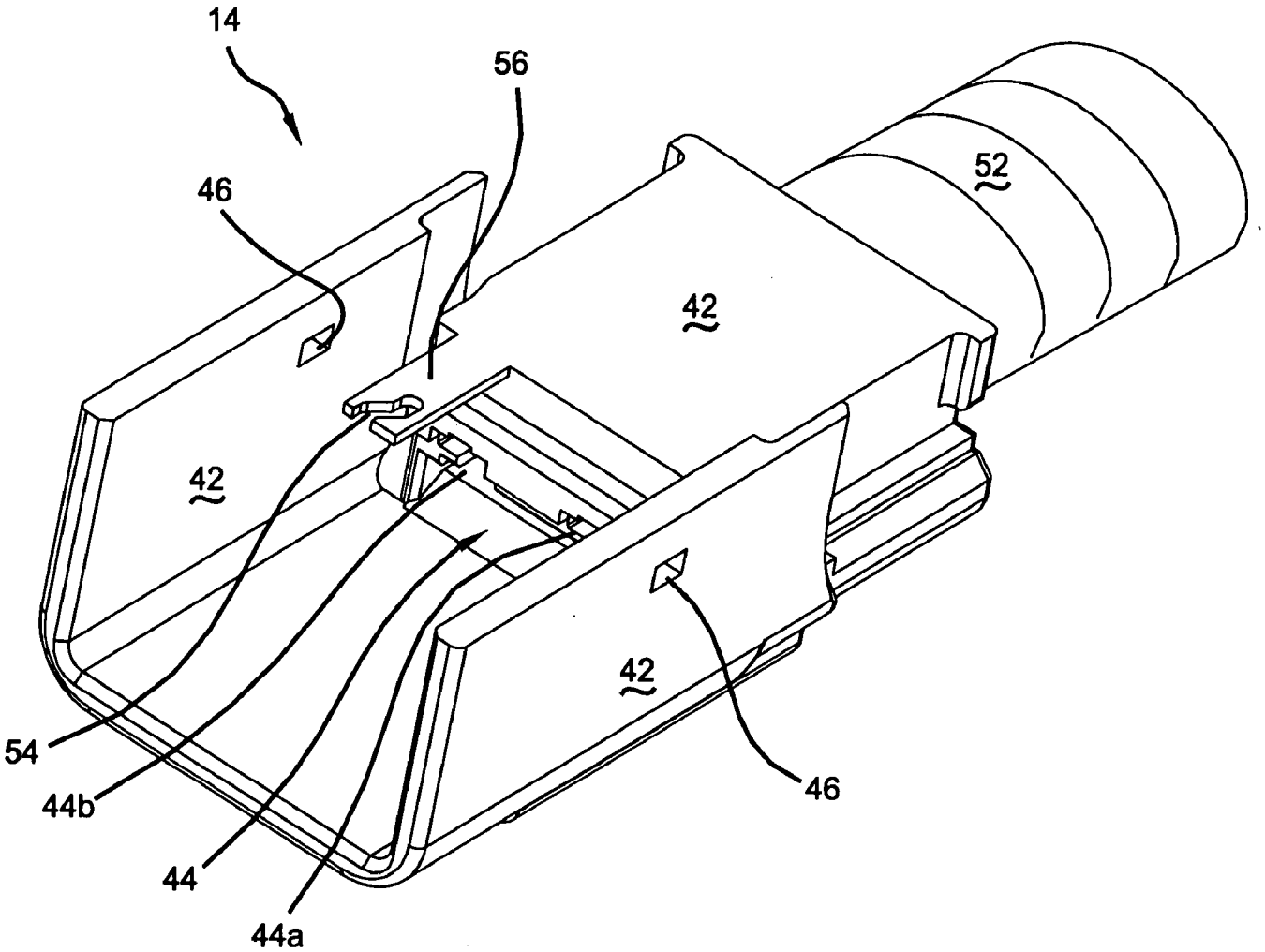
FIG. 4 is a perspective view of an alternative construction of the male connector of FIG. 1.

With reference to FIG. 4, an alternative embodiment of the male connector 14 is shown. The male connector 14 includes a cam groove 54 that may be formed in a boom 56, which connects to the male connector 14. The boom 56 may extend from the male connector 14 in a direction that is opposite the electrical wire 50 and toward the eventual female connector 12. The cam groove 54 may capture the post 36 (FIG. 3) on the shorting bar 18. It will be appreciated that the cam groove 54 can cooperate with the post 36 or cam follower 36, such that the cam follower 36 may be urged by the cam groove 54.

Figure 5:
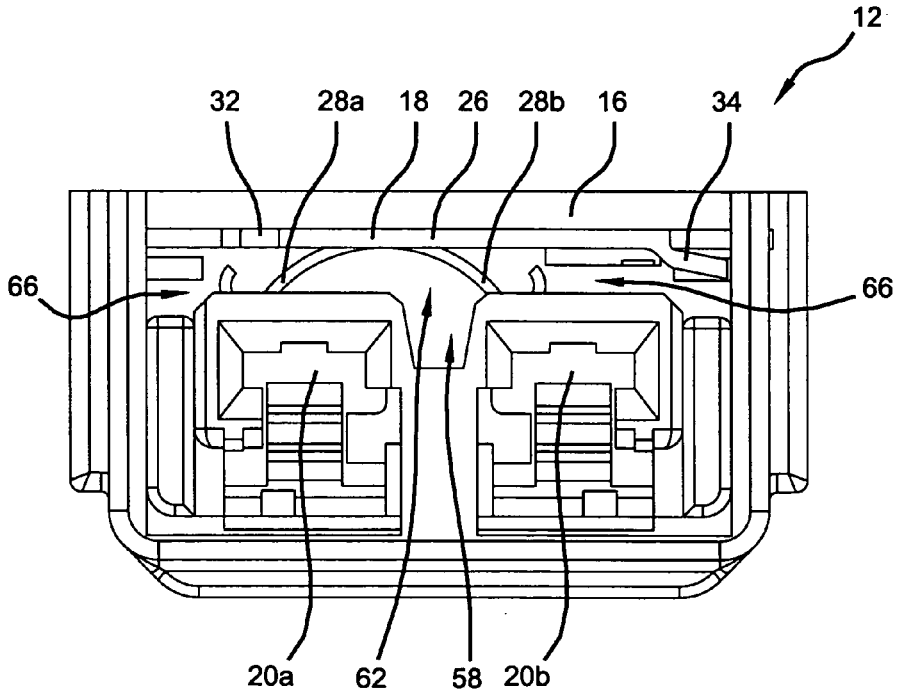
FIG. 5 is a front view of the female connector showing female terminals and the shorting bar in a shorted condition.
Figure 6:
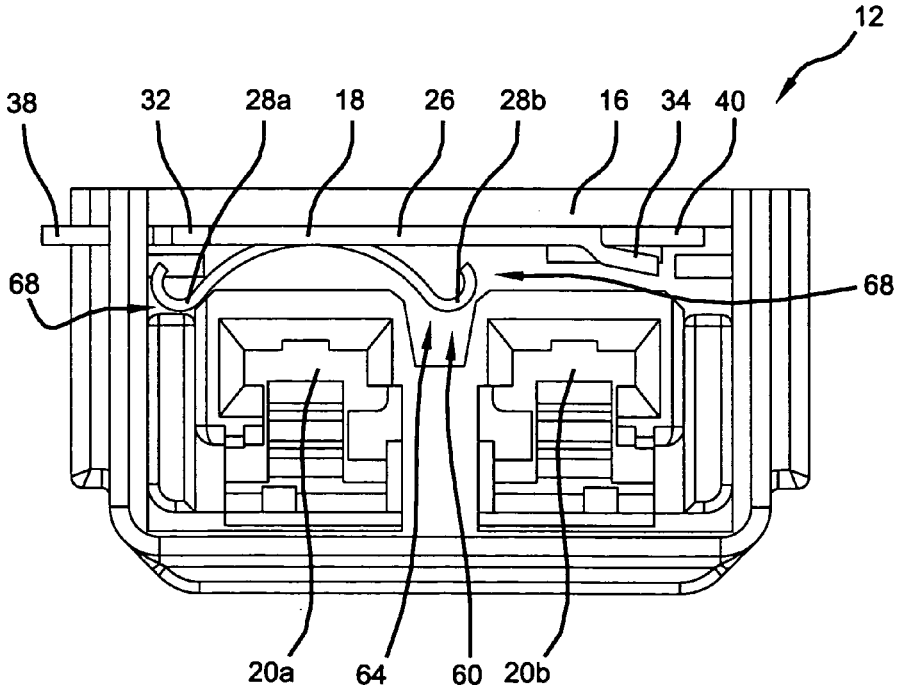
FIG. 6 is similar to FIG. 5 and shows the shorting bar is a non-shorted condition.

With reference to FIGS. 5 and 6, the shorting bar 18 may be selectively moved between a first position 58 (FIG. 5) and a second position 60 (FIG. 6). With reference to FIG. 5, the first position 58 of the shorting bar 18 can correspond to a shorted condition 62, which may also be referred to as a full-set position. In the shorted condition 62 or the full-set position, the shorting bar 18 can short the female terminals 20. With reference to FIG. 6, the second position 60 of the shorting bar 18 can correspond to a non-shorted condition 64, which may also be referred to as a preset position. In the non-shorted condition 64 or the pre-set position, the shorting bar 18 is electrically disconnected from the female terminals 20.

When the shorting bar 18 is in the shorted condition 62 (FIG. 5), the spring portions 28 contact with the female terminals 20 of the female connector 12. More specifically, the spring portions 28 are in a deflected condition 66, which is against the bias of the spring portion. Moreover, the spring portions 28 are bent into the deflected condition 66 due to the decreased space between the bar portion 26 of the shorting bar 18 and the female terminals 20. When the shorting bar 18 is in the non-shorted condition 64 or the preset position, however, the spring portions 28 are in a relaxed condition 68. In the relaxed condition 68, the spring portions 28 are not positioned against the bias of the spring portion 28. By not being positioned against the bias of the spring portions 28, the spring portions 28 are not susceptible to stress relaxation (i.e., the spring portion 28 being held in a bent shape due to long periods spent in the deflected condition 66). It will be appreciated that the spring portions 28 of the shorting bar 18 are not susceptible to stress relaxation because the connectors 12, 14 are typically mated and the shorting bar 18 is typically in the non-shorted condition 64 for the vast majority of their lifetime. As such, the spring portions 28 remain in the relaxed condition 68 (i.e., not bent) for the vast majority of the lifetime of the connector assembly 10.

With reference to FIGS. 5 and 6, when the shorting bar 18 is moved between the first position 58 (FIG. 5) and the second position 60 (FIG. 6), the spring portions 28 travel over the contact plates 24 of the female terminals 20. By traveling over the contact plates 24, the spring portions 28 perform a brushing or wiping action. To that end, oxides may accumulate on the contact plates 24 and as the shorting bar 18 is moved between the first position 58 the second position 60, the spring portions 28 may wipe oxides and other contaminants from the female terminals 20, thus cleaning the female terminals 20. It will be appreciated that the flange 34 may stop movement of the shorting bar 18 as the flange 34 abuts the female housing 16 in the first position 58. It will also be appreciated that the protrusion 32 may stop movement of the shorting bar 18 as the protrusion 32 abuts the female housing 16 in the second position 60.

Figure 7:
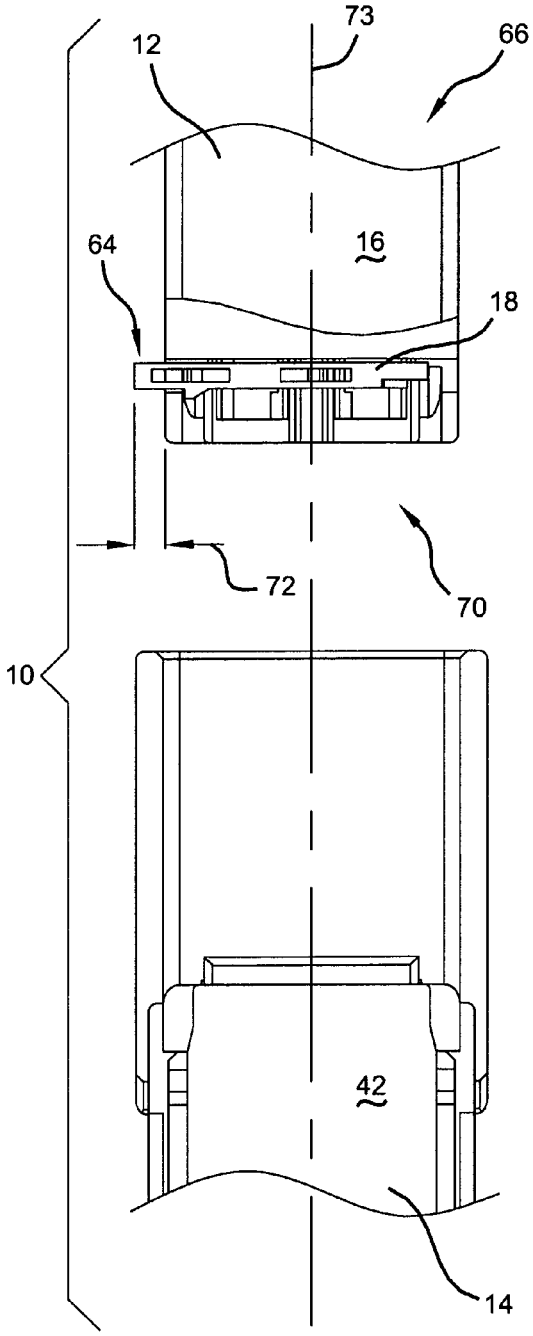
FIG. 7 is a top view of the male connector and the female connector having the shorting bar of FIG. 1 showing the shorting bar in the non-shorted condition.

With reference to FIGS. 7, 8, 9 and 10, one embodiment of an assembly and disassembly process 70 is shown that includes the female connector 12 mating (i.e., electrically connecting) to the male connector 14. With reference to FIG. 7, the female connector 12 is provided with the shorting bar 18 in the non-shorted condition 64 or the preset position. The male connector 14 is then positioned in line with the female connector 12 but not yet mated together. It will be appreciated that the first end 38 of the shorting bar 18 extends out of one of the apertures in the female housing 16. Because the shorting bar 18 protrudes from the female housing 16, the male connector 14 is unable to mate with the female connector 12 due to interference, as generally indicated by reference number 72, between the shorting bar 18 and the male housing 42.

Figure 8:
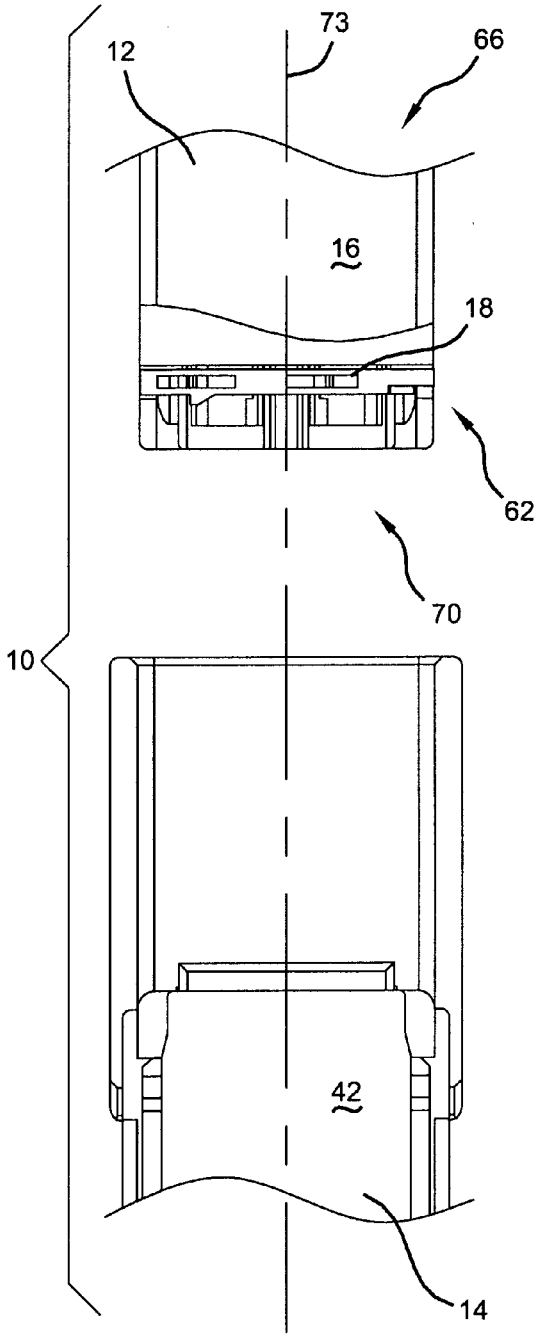
FIG. 8 is similar to FIG. 7 and shows the shorting bar in the shorted condition.
Figure 9:
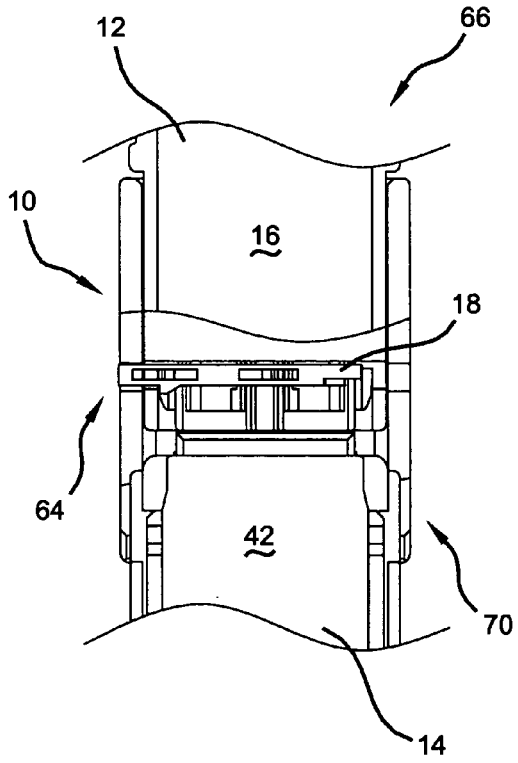
FIG. 9 is similar to FIG. 7 and shows the female connector mated to the male connector and the shorting bar is in the non-shorted condition.

With reference to FIG. 8, the shorting bar 18 may be moved from the non-shorted condition 64 or the preset position (FIG. 7) to the shorted condition 62 or the full-set position. The shorting bar 18 does not interfere with the male housing 42 in the non-shorted condition 64, which permits the female connector 12 to be mated to the male connector 14 along an insertion axis 73. With reference to FIG. 9, the female connector 12 is shown mated to the male connector 14. With the connectors 12, 14 mated together, the male terminals 44 are electrically connected to the female terminals 20, thus electrically connected to the electrical wires 50, 52 (FIG. 1). It will be appreciated in light of the disclosure that the male terminals 44 and the female terminals 20 can be parallel with the insertion axis 73 and each of the terminals 44, 20 can be spaced from one another. With the connectors 12, 14 mated, the shorting bar 18 can be moved to the non-shorted condition 64 or the preset position, thus removing the short on the female terminals 20. Moreover, the shorting bar 18 now extends through one of the apertures 22, 46 (also in FIG. 1) on each of the female and the male housing 16, 42, thus locking the connectors 12, 14 together.

Figure 10:
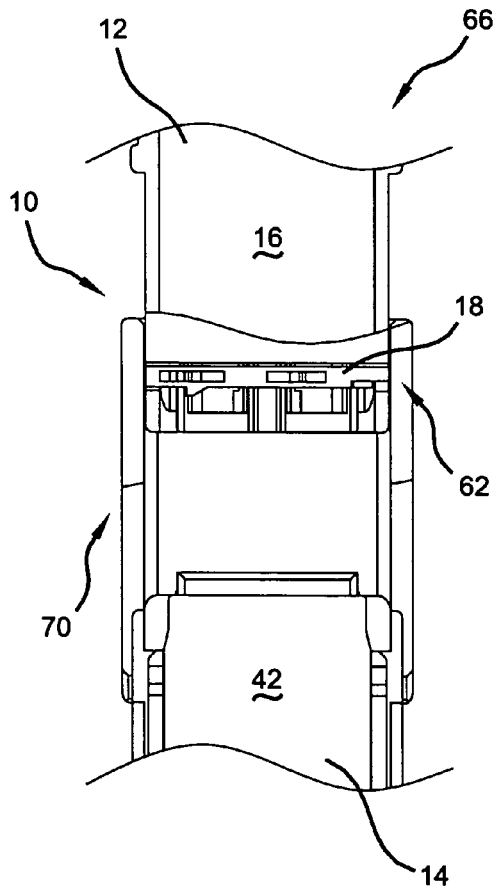
FIG. 10 is similar to FIG. 7 and shows the male connector unmated from the female connector and the shorting bar in the shorted condition.

With reference to FIG. 10, the shorting bar 18 is moved into the shorted condition 62 or the full-set position. In the shorted condition 62 or the full-set position, the shorting bar 18 shorts the female terminals 20 and is no longer locking the connectors 12, 14 together. As such, the connectors 12, 14 can be unmated, but when the shorting bar 18 is in the shorted condition 62. It will be appreciated that the connector assembly 10 provides a mate-to-brake functionality. More specifically, the female terminals 20 must be shorted before the connectors 12, 14 may be electrically disconnected, which, in turn, provides that the female terminals 20 are shorted before the connectors 12, 14 are electrically re-connected. Moreover, the electrical potential of both of the connectors 12, 14 is equalized before the connectors 12, 14 can be disconnected.

Figure 11:
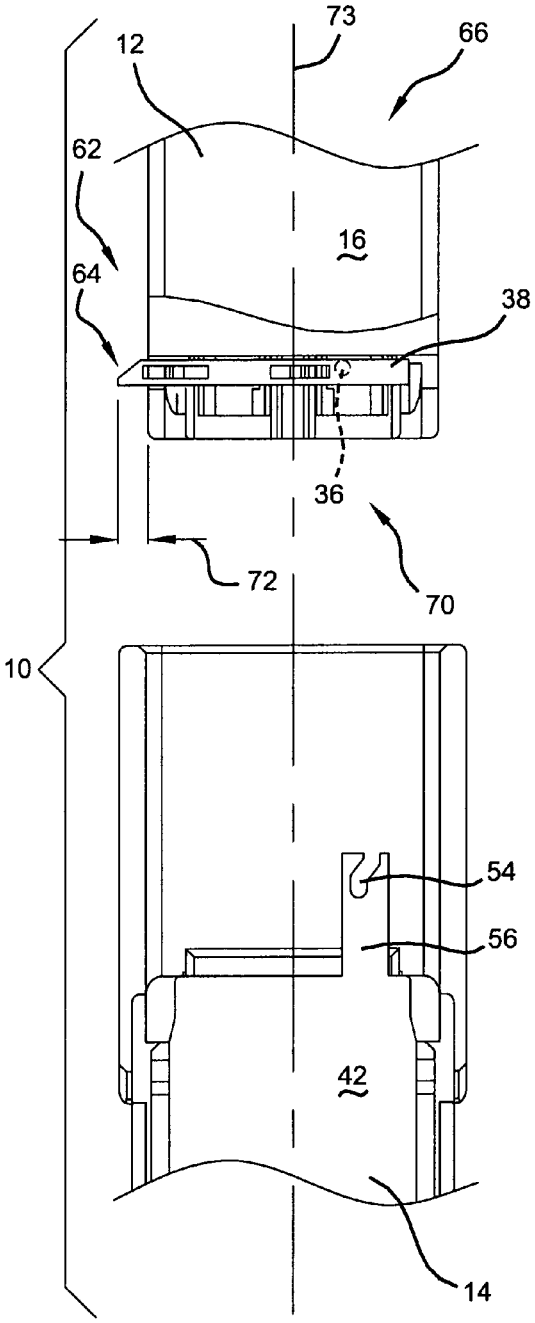
FIG. 11 is a top view of the male connector of FIG. 4 and the female connector having the shorting bar of FIG. 3 showing the shorting bar positioned in the non-shorted condition.

With reference to FIGS. 11, 12, 13A, 13B, 13C and 14, another embodiment of the present invention is shown and includes an automatic shorting assembly and disassembly process 74. With reference to FIG. 11, the female connector 12 is provided with the alternative construction of the shorting bar 18 (FIG. 3) in the non-shorted condition 64 or the preset position. The alternative construction of the male connector 14 (FIG. 4) is then positioned in line with the female connector 12 but not yet mated together. It will be appreciated that the first end 38 of the shorting bar 18 extends out of one of the apertures 22 in the female housing 16. Because the shorting bar 18 protrudes from the female housing 16, the male connector 14 is unable to mate with the female connector 12 due to interference, as generally indicated by reference number 72, between the shorting bar 18 and the male housing 42.

Figure 12:
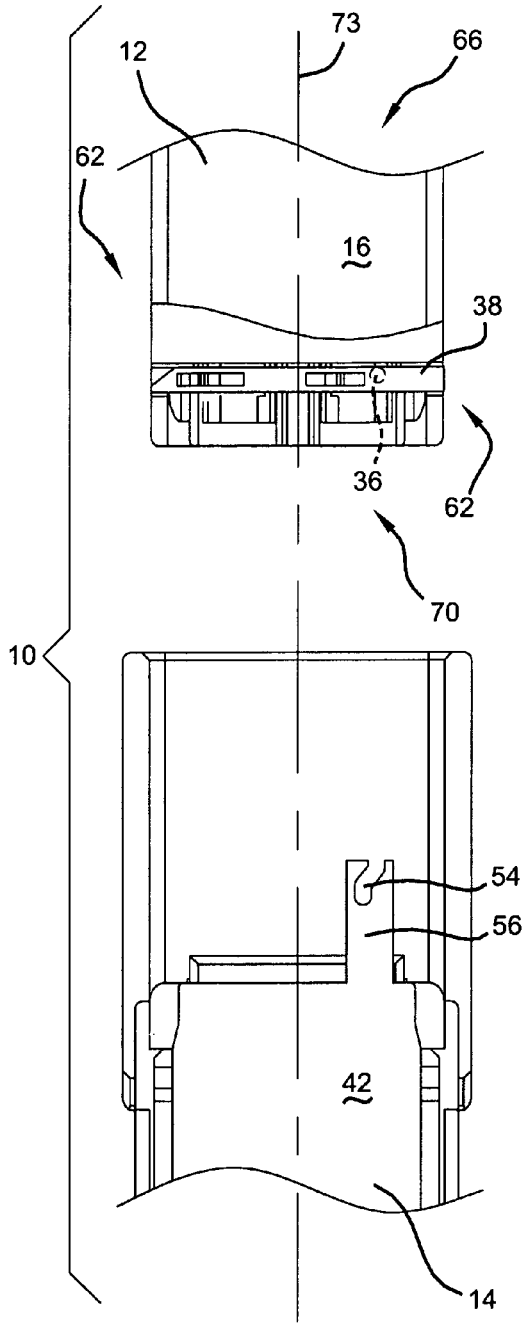
FIG. 12 is similar to FIG. 11 and shows the shorting bar in the shorted condition.
Figures 13A, 13B, 13C:
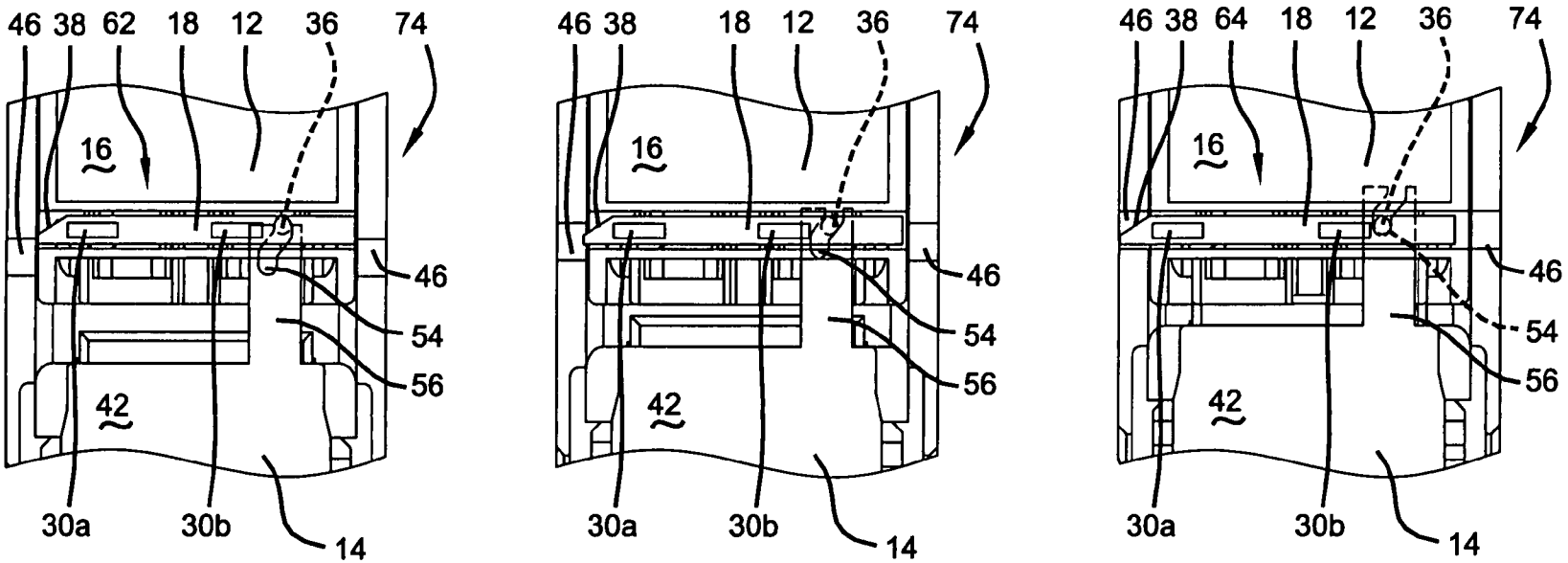
FIGS. 13A, 13B and 13C are similar to FIG. 11 and show a progression of a grooved catch on the male connector urging the shorting bar from the shorted condition to the non-shorted condition.

With reference to FIG. 12, the shorting bar 18 is moved from the non-shorted condition 64 or the preset position (FIG. 11) to the shorted condition 62 or the full-set position. The shorting bar 18 does not interfere with the male housing 42 in the non-shorted condition 64, which permits the female connector 12 to be mated to the male connector 14 along the insertion axis 73. With reference to FIGS. 13A, 13B and 13C, the female connector 12 is shown in a progression mating to the male connector 14. In FIG. 13A, the cam groove 54 captures the post 36 on the shorting bar 18 (also in FIG. 3), as the connectors 12, 14 are connected but not yet mated. In FIG. 13B, the connectors 12, 14 begin to mate as the cam groove 54 urges the shorting bar 18 from the shorted condition 62 to the non-shorted condition 64.

With reference to FIG. 13C, the connectors 12, 14 are mated and the cam groove 54 has urged the shorting bar 18 in the non-shorted condition 64, thus locking the connectors 12, 14 to one another. With the connectors 12, 14 mated together, the male terminals 44 are electrically connected to the female terminals 20, thus electrically connecting the electrical wires 50, 52 (FIG. 1). With the connectors 12, 14 mated together, the shorting bar 18 can be moved to the non-shorted condition 64 or the preset position, thus removing the short on the female terminals 20. In the non-shorted condition 64, the shorting bar 18 extends through one of the apertures 22, 46 (also in FIG. 1) on each of the female and the male housing 16, 42, thus locking the connectors 12, 14 together.

Figure 14:
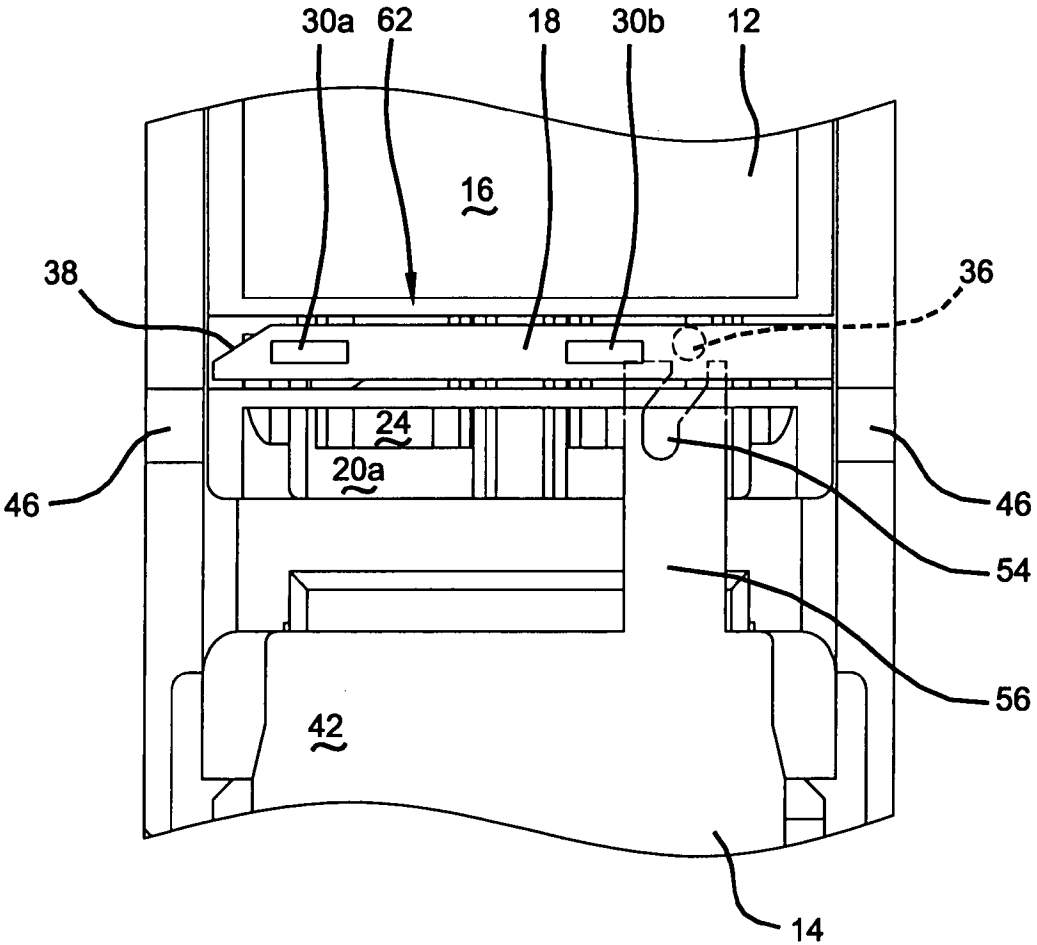
FIG. 14 is similar to FIG. 11 and shows the shorting bar in the shorted condition and the female connector unmated from the male connector.

With reference to FIG. 14, the connectors 12, 14 may be pulled apart from one another. As the connectors 12, 14 are pulled apart, the cam groove 54 urges the shorting bar 18 from the non-shorted condition 64 to the shorted condition 62. In the shorted condition 62 or the full-set position, the shorting bar 18 shorts the female terminals 20 and no longer locks the connectors 12, 14 together. As such, the connectors 12, 14 can be unmated, but can only be unmated when the shorting bar 18 is in the shorted condition 62.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electrical connector comprising:

a housing having at least a first electrical terminal and a second electrical terminal, said first electrical terminal and said second electrical terminal are generally parallel to an insertion axis and spaced from one another; and a shorting bar slidably connected to said housing and having at least a first spring portion and a second spring portion, said shorting bar movable between a shorted condition that electrically connects said terminals together and a non-shorted condition, wherein said spring portions in said non-shorted condition are in a relaxed position;

said shorting bar lies in a first plane;

a protrusion that extends in a direction from said shorting bar that is parallel to said first plane; and a flange or a post that extends in a direction from said shorting bar that is parallel to a second plane, said first and second planes intersect.

2. The electrical connector of claim 1 wherein said first terminal includes a contact plate, said first spring portion of said shorting bar electrically connecting to said contact plate in said shorted condition, said first spring portion wiping said contact plate as said shorting bar moves between said shorted condition and said non-shorted condition.

3. The electrical connector of claim 1 wherein the electrical connector is a first electrical connector that connects to a second electrical connector, said shorting bar in said non-shorted condition locking said second connector to said first connector.

4. The electrical connector of claim 1 wherein the electrical connector is a first electrical connector that is operable to connect to a second electrical connector, said shorting bar in said non-shorted condition preventing said second connector to mate with said first connector.

5. The electrical connector of claim 1 wherein said shorting bar in said shorted condition electrically connects said first spring portion to said first electrical terminal and said second spring portion to said second electrical terminal to thereby electrically connect said first electrical terminal to said second electrical terminal.

6. The electrical connector of claim 1 further comprising a plurality of electrical terminals, said shorting bar having a plurality of spring portions, wherein said shorting bar in said shorting condition electrically connects at least two of said terminals together.

7. An electrical connector assembly comprising;

a first electrical connector having a pair of first terminals;

a shorting bar slidably connected to said first electrical connector having a cam follower connected thereto, said shorting bar movable between a first position that electrically connects said first terminals and a second position that does not electrically connect said first terminals;

a second connector having a pair of second terminals, each of said second terminals being complementary to an associated one of said first terminals;

a cam connected said second connector, said cam cooperating with said cam follower, wherein said cam urges said shorting bar to said second position when said first electrical connector is mated to said second electrical connector and said cam urges said shorting bar to said first position when said first electrical connector is disconnected from said second electrical connector; and a first spring portion and a second spring portion connected to said shorting bar, wherein said first spring portion and said second spring portion are in a relaxed condition when said shorting bar is positioned in said second position.

8. The electrical connector assembly of claim 7 wherein said first terminal includes a contact plate, said first spring portion of said shorting bar electrically connecting to said contact plate in said first position, said first spring portion wiping said contact plate as said shorting bar moves from said first position to said second position.

9. The electrical connector assembly of claim 7 wherein said shorting bar in said second position engages said second connector to thereby lock said second connector and said first connector together.

10. The electrical connector assembly of claim 7 wherein said shorting bar in said second position interferes with said second connector to thereby block said second connector and said first connector from mating.

11. The electrical connector assembly of claim 7 wherein said shorting bar in said second position inhibits said second connector from mating with said female connector.

12. The electrical connector assembly of claim 7 wherein said shorting bar in said first position electrically connects said first spring portion to said first electrical terminal and said second spring portion to said second electrical terminal.

* * * * *